US010449431B1

(12) United States Patent
Cyr

(10) Patent No.: US 10,449,431 B1
(45) Date of Patent: Oct. 22, 2019

(54) BASKETBALL TRAINING DEVICE

(71) Applicant: Gregory G. Cyr, Fort Kent, ME (US)

(72) Inventor: Gregory G. Cyr, Fort Kent, ME (US)

( * ) Notice: Subject to any disclaimer, the term of this patent is extended or adjusted under 35 U.S.C. 154(b) by 0 days.

(21) Appl. No.: 16/367,763

(22) Filed: Mar. 28, 2019

Related U.S. Application Data

(60) Provisional application No. 62/650,347, filed on Mar. 30, 2018.

(51) Int. Cl.
*A63B 69/00* (2006.01)
*A63B 63/08* (2006.01)

(52) U.S. Cl.
CPC ..... *A63B 63/083* (2013.01); *A63B 69/0071* (2013.01)

(58) Field of Classification Search
CPC ..... A63B 69/0071; A63B 63/083
USPC ..... 473/447, 448
See application file for complete search history.

(56) References Cited

U.S. PATENT DOCUMENTS 3,160,414 A * 12/1964 Gray ..... A63B 63/083 473/448
5,207,789 A * 5/1993 Gates ..... A63B 63/083 473/448
5,800,290 A * 9/1998 Barry ..... A63B 63/00 473/438
6,932,723 B1 * 8/2005 Klinger ..... A63B 69/0071 473/422
8,162,781 B2 * 4/2012 Heflin, Sr. ..... A63B 69/0071 473/448
9,782,650 B1 * 10/2017 Holcomb ..... A63B 69/0071
2004/0043841 A1 * 3/2004 Williams ..... A63B 69/0071 473/448
2006/0035735 A1 * 2/2006 Baker ..... A63B 69/0071 473/448
2010/0267495 A1 * 10/2010 Heystek ..... A63B 69/0071 473/447
2013/0040765 A1 * 2/2013 Myles ..... A63B 63/083 473/447
2016/0121184 A1 * 5/2016 Seaman ..... A63B 63/083 473/447
2017/0239542 A1 * 8/2017 Seto ..... A63B 63/083
2018/0304137 A1 * 10/2018 McErlean ..... A63B 69/0071
2018/0353824 A1 * 12/2018 Brooks, III ..... A63B 69/0071

* cited by examiner

*Primary Examiner* — Mark S Graham
(74) *Attorney, Agent, or Firm* — Jeffrey Joyce, Esq.

(57) ABSTRACT

A basketball training device that helps a basketball player learn where to aim when taking a shot including one or more targets that are secured to a basketball rim by an attachment mechanism.

5 Claims, 7 Drawing Sheets

BASKETBALL TRAINING DEVICE

BACKGROUND INFORMATION

Field of the Invention

The invention relates to basketball training devices, particularly devices that train basketball players where to look and aim while shooting the basketball.

Discussion of Prior Art

Basketball is an old and well-known sport that generally involves players on two competing teams shooting a ball through a hoop that is typically 10 feet off the ground. A number of training devices exist to help a player develop the proper body mechanics. However, in addition to learning the proper body movements' players must also learn to use their eyes to target the proper spot to shoot at. Without the proper visual target a player's hand-eye coordination cannot fully assist a player in making a shot.

What is needed, therefore, is a device that trains a player where to look as he or she is taking a shot.

BRIEF SUMMARY OF THE INVENTION

The invention is a training device that positions one or more targets on the proper position on a basketball rim, such that when a player looks to take a shot, he/she knows where to aim.

The targets are visual indicators that are positioned on an outer side of the rim, sized to be sufficiently large so that a shooting player has no problem identifying and/or locating the target, while also being sufficiently small such that they do not interfere with the path of the basketball as it approaches and the falls through the rim.

An attachment mechanism is provided that releasably secures the one or more targets in the proper position. In one embodiment, the targets are attached to a tight fitting sleeve that is sized and shaped to fit securely on the rim. In another embodiment each target has an individual attachment mechanism that fits over a net holder and then loops around the rim and back through an attachment point on the attachment mechanism.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-5 show a basketball training device 100 according to the invention, including a first embodiment of an attachment mechanism 10 and one or more targets 20. The attachment mechanism 10 secures the targets 20 to a basketball rim R, and positions the targets 20 at specific points along the rim R.

It is generally known that it is best for a shooter to target the rim R when shooting a basketball. This helps the shooter identify the proper direction and distance for the shot, and so long as another player is not in the shooter's path, a portion of the rim R is always visible to the shooter. As such, the basketball training device 100 securely attaches the targets 20 to the rim R in a manner that causes the targets 20 to be easily identified by the shooter without obscuring the path of the basketball.

Figure 1:
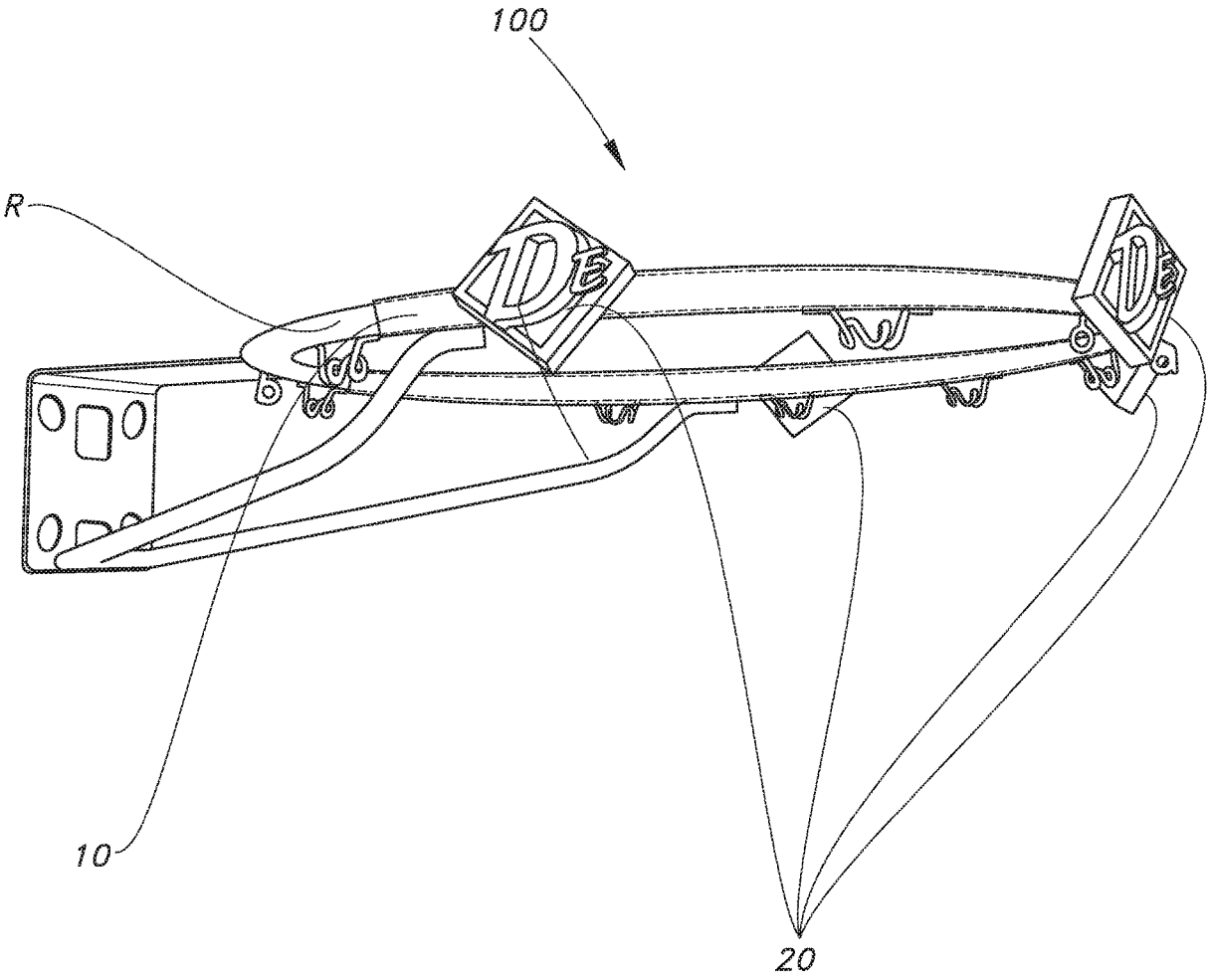
FIG. 1 is a perspective view of a basketball training device according to the invention, showing the sides of the device, the device including a first embodiment of an attachment mechanism and being attached to a rim.
Figure 2:
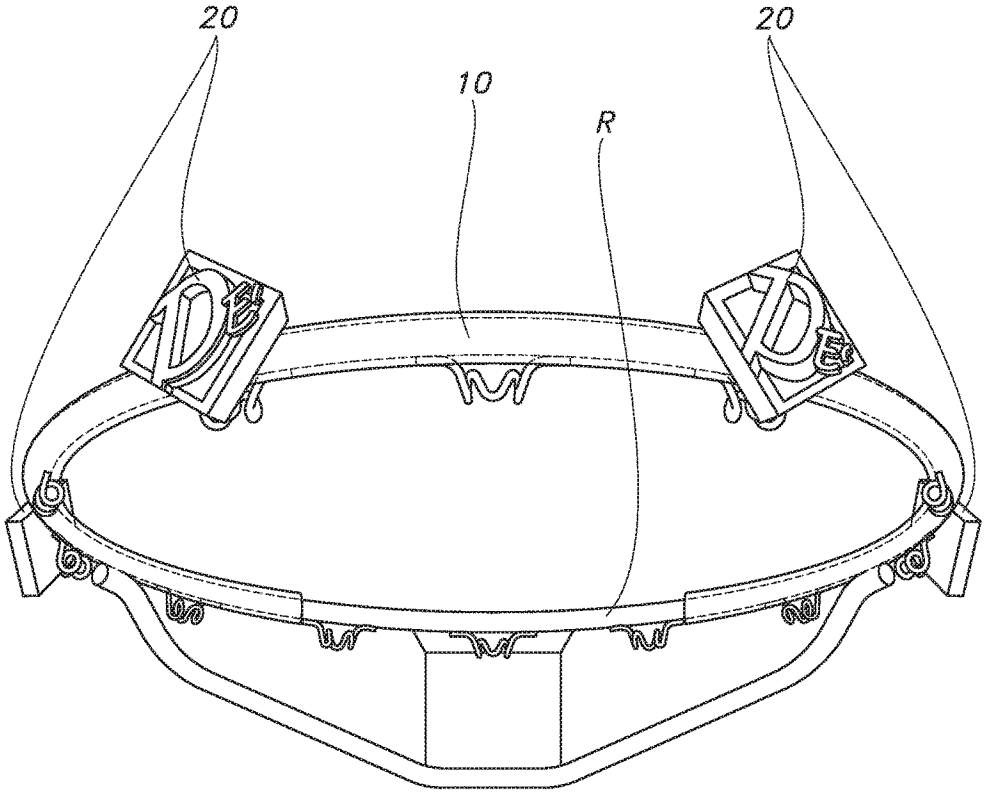
FIG. 2 is a perspective view of the device showing the front and bottom of the device.
Figure 3:
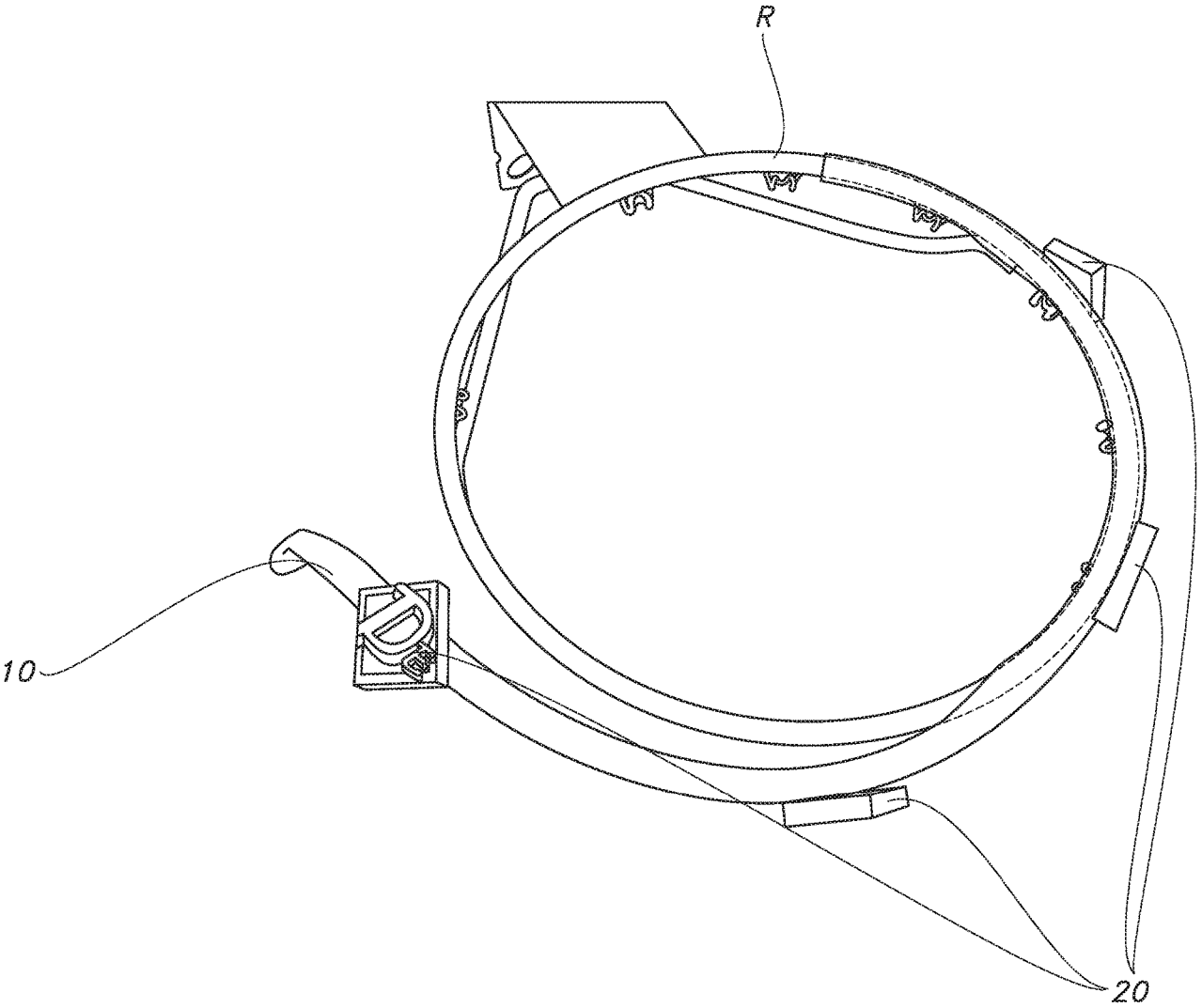
FIG. 3 is a top view of the device partially attached to a basketball rim.
Figure 4:
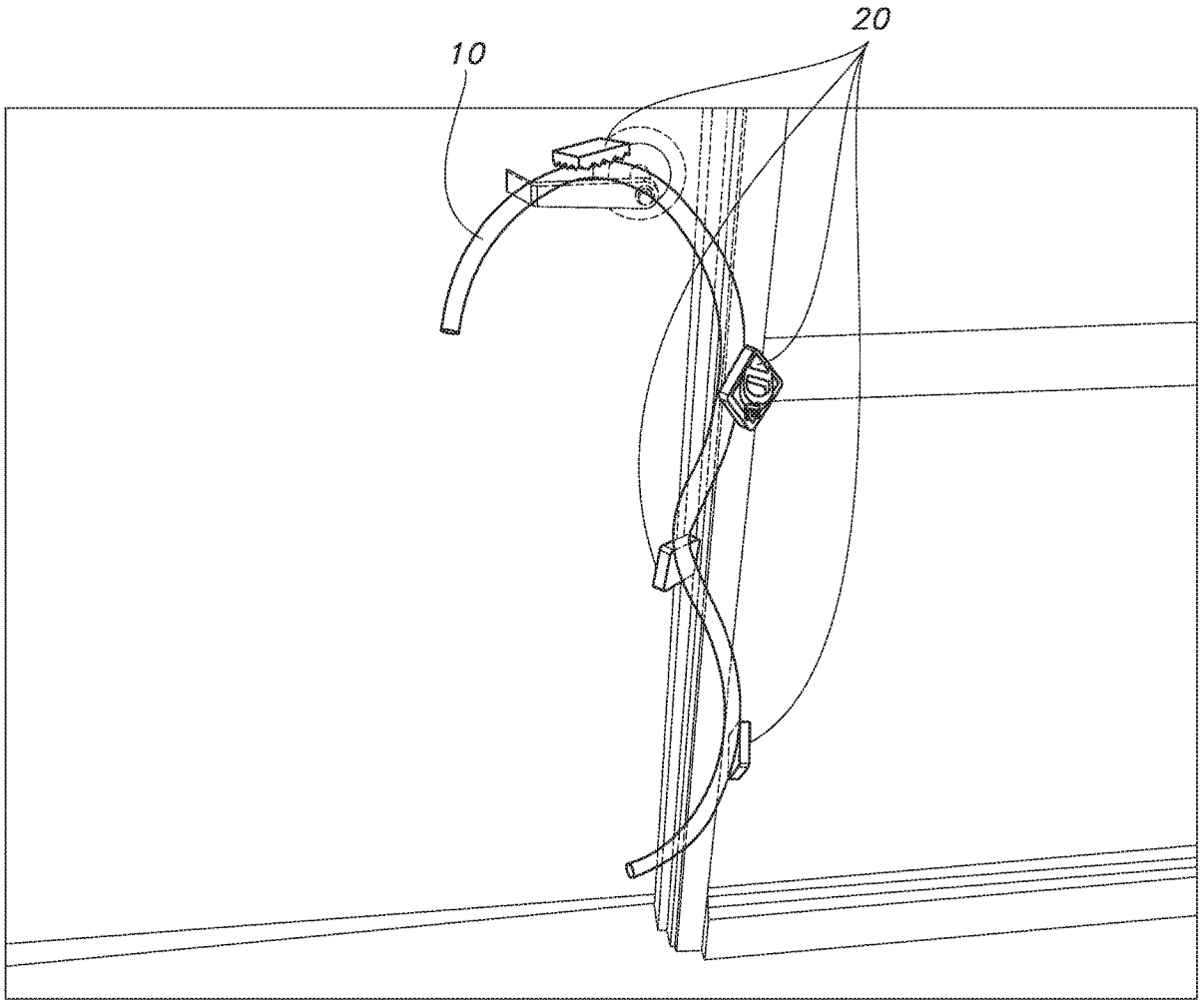
FIG. 4 is a view of the device not attached to a rim but rather hanging from a hook.
Figure 5:
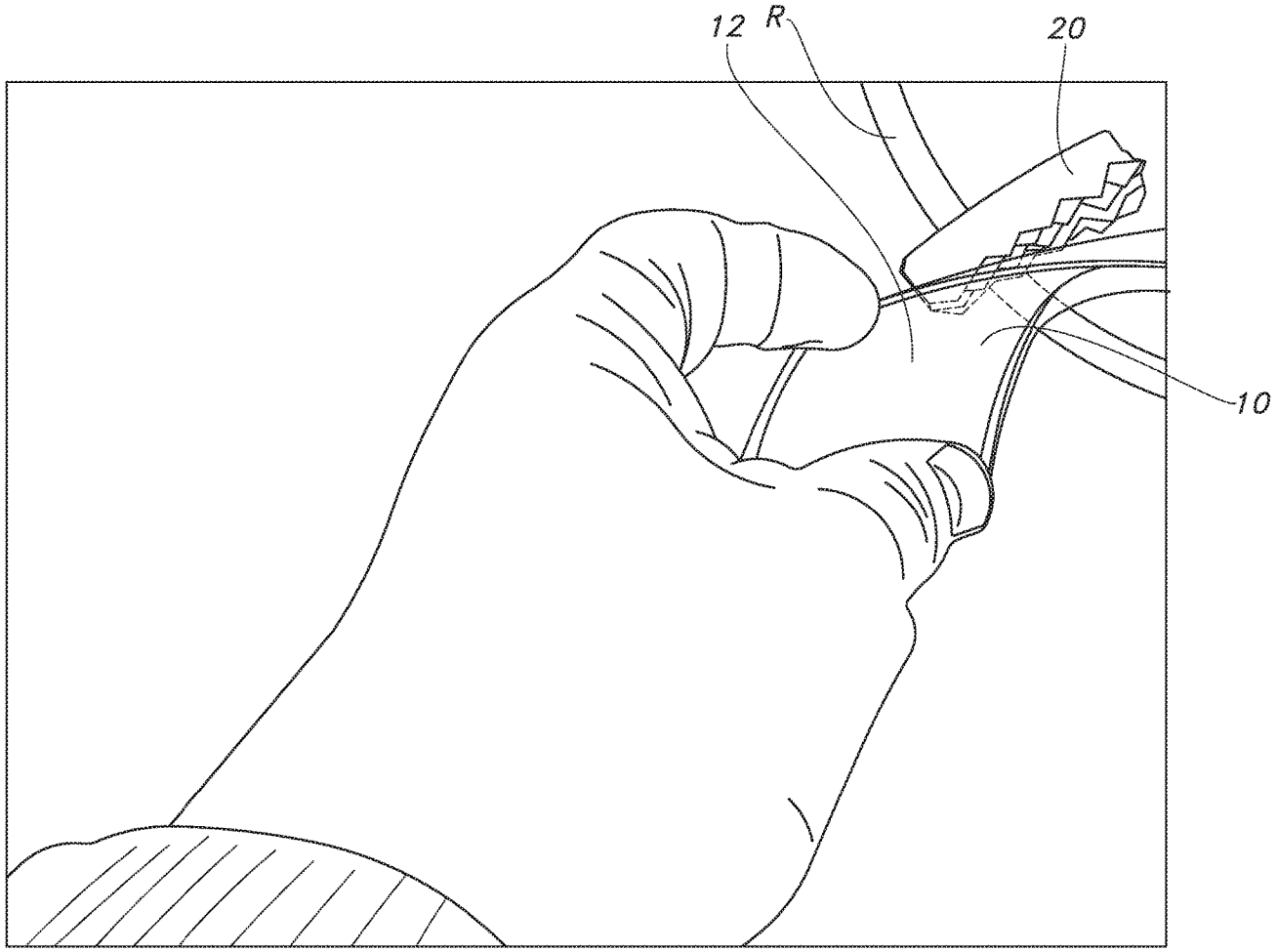
FIG. 5 is a top view of the attachment mechanism being opened by a user.
Figure 6:
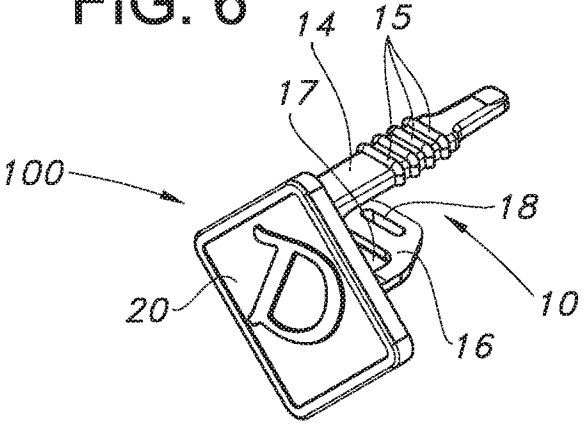
FIG. 6 is a front perspective view of the device according to the invention having a second embodiment of the attachment mechanism in an unsecured position.

The targets 20 are small visual indicators that are connected to the attachment mechanism 10 and visible to the shooter. The number of targets 20 may vary; however, placing four targets around the front and sides of the rim R as shown in FIGS. 1-3 is ideal. In this manner, shooters who are taking "corner" shots have a target on either side of the rim R and shooters who are not in a corner always have a target located towards the front of the rim R. The targets 20 are attached to the attachment mechanism 10 using conventional mechanism such as, for example, adhesives, hook and loop fasteners, welding, mechanical fasteners, and/or the attachment mechanism 10 and targets 20 may be formed as a single molded unit.

The targets 20 in the embodiment shown are diamond shaped and may include various colors. The size of the targets 20 may also vary, however, targets 20 that are 2 inches wide by 2 inches high are particularly advantageous as these dimensions provide an identifier that is highly visible but that does not impede the path of the basketball through the rim R.

In the first embodiment, the attachment mechanism 10 is a sleeve that fits securely over the rim R. There are many conventional materials that may be used for the sleeve, such as clear plastic tubing or synthetic rubber. Having a sleeve made of polyvinyl chloride (PVC) may be particularly advantageous. The attachment mechanism has a slot opening 12, shown in FIG. 5, on a bottom side of the sleeve for easy insertion over the rim R, and while the sleeve may be forcibly opened to fit over and onto the rim it is formed to fit snuggly against the rim R once inserted in the proper position. In this manner, the attachment mechanism 10 does not obscure the shooter's view of the rim R and it does not interfere with the basketball's path through the rim R.

FIGS. 6-12 illustrate the device 100 having a second embodiment of the attachment mechanism 10 that includes an upper arm 14 and a lower arm 16 that are affixed to the target 20. The arms 14, 16, may be affixed to the target 20 using a number of conventional means, such as, for example, adhesives or threaded fasteners, or they may be formed as a part of the device, for example, as a single molded component. The lower arm 16 is relatively rigid such that it holds its form when secured to the rim R. To attach the device 100 to the rim the R the lower arm 16 is inserted on or under the bottom side of the rim R where a first opening 17 secures around a net holder on the rim R. The upper arm 14 is flexible and extends over a top side of the rim where it is bent downward and inserted through a second opening 18, with ridges 15 on the upper arm 14 securing the upper arm 14 in the second opening 18. The upper arm 14 is comprised of a bendable material such that it is able to be bent around the rim to connect with the lower arm yet still have the strength to secure such a position. There are a number of suitable materials for the upper arm 14, such as, for example, a thermoplastic vulcanizate such as SANTOPRENE.

Either embodiment may be constructed in any suitable size, such that the attachment mechanism fits securely on the intended portion of the rim and the target is visible without obstructing the path of the ball. In regards to the second embodiment of the attachment mechanism, having an upper arm 14 that is approximately 2.5 inches in length and a lower arm 16 having a second opening that is approximately 1 inch from the target creates a device that is well suited to attach to a rim having a ⅝ inch diameter.

Figure 11:
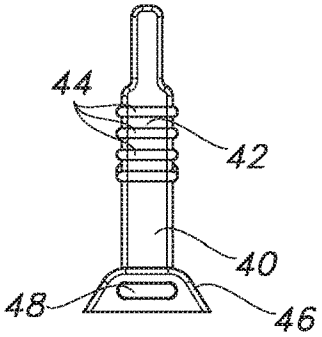
FIG. 11 is a top view of an extension arm.
Figure 8:
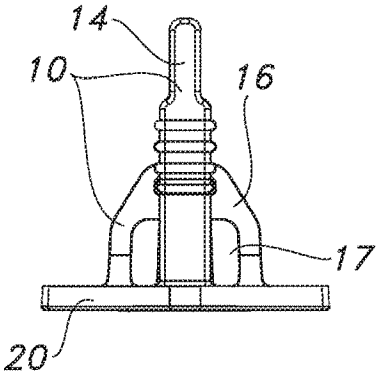
FIG. 8 is a top view of the device.
Figure 10:
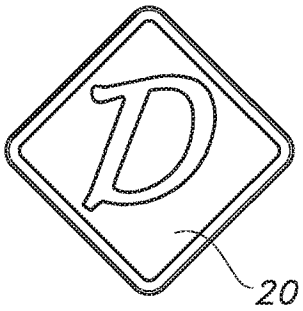
FIG. 10 is a front view of the device.
Figure 7:
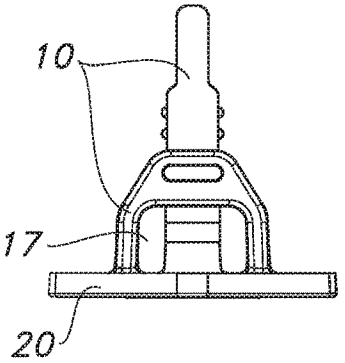
FIG. 7 is a bottom view of the device.
Figure 9:
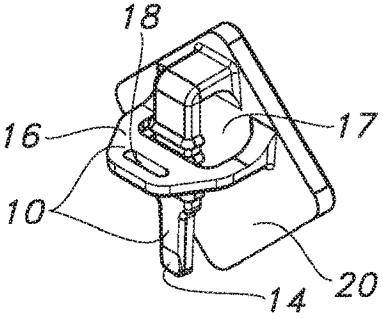
FIG. 9 is a rear perspective view of the device showing the upper arm in a position for packaging and sale.
Figure 12:
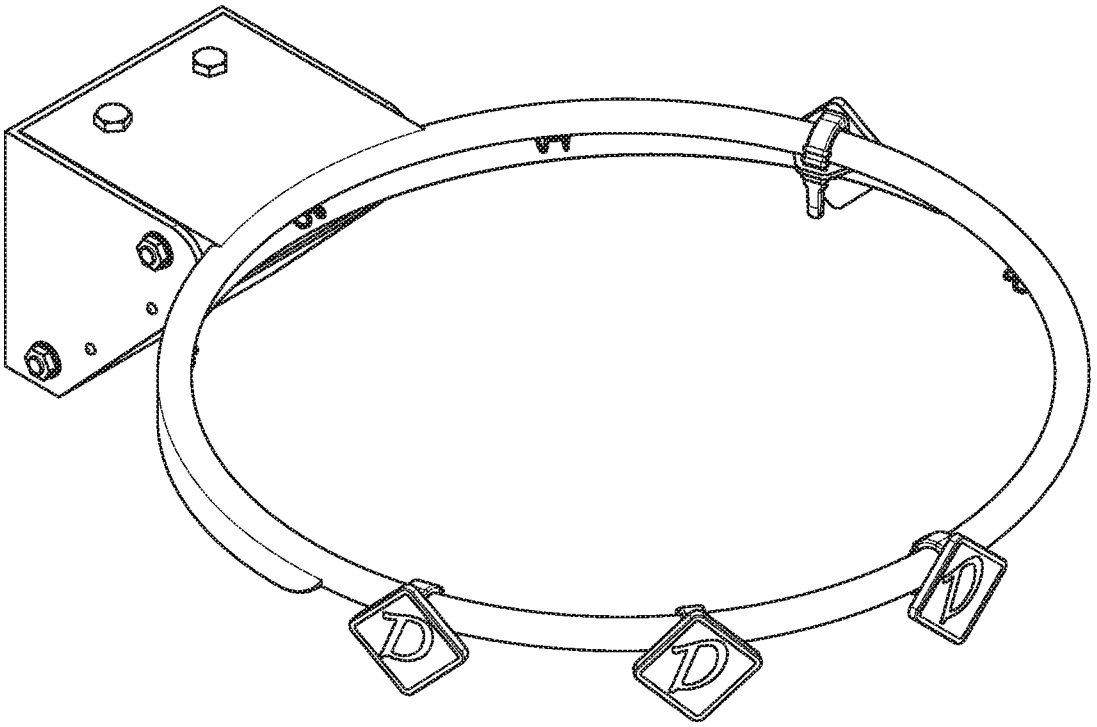
FIG. 12 illustrates the second embodiment of the attachment mechanism secured to a basketball rim.

If the device is created with the aforementioned dimensions and a user wishes to apply the device to a larger rim an extension arm 40, shown in FIG. 11, may be used. The extension arm 40 includes a male end 42 having one or more protrusions 44 that is very similar in structure to the upper arm 14, and a female end 46 having an opening 48 that is very similar to the second opening 18 on the lower arm 16. To use the extension arm 40, the upper arm 14 of the attachment mechanism 10 is secured in the female end 46 of the extension arm 40 and the male end 42 of the extension arm 40 is inserted into the second opening 18 on the lower arm 16. More than one extension arm be used if needed or desired.

It is understood that the embodiments described herein are merely illustrative of the present invention. Variations in the construction of the basketball training device may be contemplated by one skilled in the art without limiting the intended scope of the invention herein disclosed and as defined by the following claims.

What is claimed is:

1. A basketball training device for use with a basketball rim to train a shooter where to shoot a basketball, the basketball training device comprising:

an attachment mechanism that is attachable to the basketball rim, the attachment mechanism having one or more targets that are visible to the shooter;

wherein the one or more targets are visual indicators that are large enough to be located and viewed by a player while being small enough to avoid obstructing the path of the basketball through the basketball rim;

wherein the attachment mechanism includes a flexible upper arm and a lower arm, the upper arm including one or more protrusions and the lower arm including at least a first opening and a second opening;

wherein the upper arm extends over a top portion of the basketball rim and bends around the rim to connect with the lower arm such that at least one of the one or more protrusions are inserted through and secured in the lower's arms second opening; and wherein the lower arm's first opening fits around and secures to a net holder on the basketball rim.

2. The basketball training device of claim 1, further including an extension arm having a first end that is attachable to the upper arm and a second end that is securable to the lower arm.

3. The basketball training device of claim 1, wherein the targets have a diamond shape.

4. The basketball training device of claim 1, wherein the lower arm is comprised of a rigid material that holds its form when secured to the rim.

5. The basketball training device of claim 1, wherein the upper arm is comprised of thermoplastic vulcanizate.

* * * * *